US006739014B2

(12) United States Patent
Falck

(10) Patent No.: US 6,739,014 B2
(45) Date of Patent: May 25, 2004

(54) COATING WIPER FOR MOVING STRIP

(75) Inventor: Michael E. Falck, Wanatah, IN (US)

(73) Assignee: Roll Coater, Inc., Greenfield, IN (US)

( * ) Notice: Subject to any disclaimer, the term of this patent is extended or adjusted under 35 U.S.C. 154(b) by 0 days.

(21) Appl. No.: 10/380,131

(22) PCT Filed: Oct. 23, 2001

(86) PCT No.: PCT/US01/46079

§ 371 (c)(1),
(2), (4) Date: Mar. 11, 2003

(87) PCT Pub. No.: WO02/34584

PCT Pub. Date: May 2, 2002

(65) Prior Publication Data

US 2004/0010874 A1 Jan. 22, 2004

(51) Int. Cl.[7] ..... A47L 25/00; B08B 11/00
(52) U.S. Cl. ..... 15/102
(58) Field of Search ..... 15/100, 102

(56) References Cited

U.S. PATENT DOCUMENTS 1,914,890 A * 6/1933 Mackler ..... 15/100
2,817,862 A * 12/1957 Frazho ..... 15/3.17

* cited by examiner

*Primary Examiner*—Randall Chin
(74) *Attorney, Agent, or Firm*—Barnes & Thornburg

(57) ABSTRACT

A wiper apparatus (10) is disclosed for spreading, smoothing or otherwise wiping liquid coating material on a suites (13) of a moving ship (12), such as, for example, a moving strip of metal. The wiper apparatus (10) comprises first and second felt wipers (15) for alternately wiping the liquid coating material on the surface of the moving strip (12) and a wiper support (16) coupled to the first and second wipers (15) for rotation of the first and second wipers (15). A lift assembly (18) is used for moving the first and second wipers (15) relative to the surface of the moving strip (12) between engaged and disengaged positions.

20 Claims, 6 Drawing Sheets

COATING WIPER FOR MOVING STRIP

BACKGROUND AND SUMMARY OF THE INVENTION

The present invention relates to a wiper apparatus, and particularly to an apparatus for wiping liquid coating material on a moving strip, such as, for example, a moving strip of metal.

It is heretofore known to apply a coating of liquid material on a surface of a moving strip of metal with liquid coating material applicators. The coating may be used to protect or color the metal, for example. It typically is desirable that the liquid coating material be evenly or uniformly distributed over the surface of the moving strip.

The present invention provides a wiper apparatus for spreading, smoothing or otherwise wiping liquid coating material on a surface of a moving strip, such as, for example, a moving strip of metal. The wiper apparatus comprises first and second wipers, each wiper for alternately wiping the liquid coating material on the surface of the moving strip; and a wiper support coupled to the first and second wipers for moving the first and second wipers between a first orientation wherein the first wiper is adjacent the surface of the moving strip for wiping the liquid coating material on the surface of the moving strip and the second wiper is spaced from the surface of the moving strip, and a second orientation wherein the second wiper is adjacent the surface of the moving strip for wiping the liquid coating material on the surface of the moving strip and the first wiper is spaced from the surface of the moving strip. The first and second wipers desirably comprise felt.

Desirably, the wiper support includes a shaft coupled to at least one of the first and second wipers. The shaft is rotatable to move the first and second wipers between the first and second orientations. The wiper support may further include first and second wiper holders, at least one of which is secured to the shaft. The first wiper holder is secured to the first wiper and the second wiper holder is secured to the second wiper. One or both of the first and second wiper holders define a passageway receiving the shaft.

The shaft may be coupled to the at least one of the first and second wipers in any suitable manner that results in movement of the first and second wipers between the first and second orientations. In a preferred embodiment, for example, there are two shafts, each shaft secured to one or both of the first wiper holder and the second wiper holder. By way of further example, a single shaft can instead be used that is secured to one or both of the first and second wiper holders in accordance with alternative embodiments.

The wiper apparatus may also include a lift assembly for lifting or otherwise moving the first and second wipers between an engaged position in which one of the first and second wipers is adjacent the surface of the moving strip and a disengaged position in which both of the first and second wipers are spaced from the surface of the moving strip. The lift assembly desirably comprises at least one arm coupled to the one or more shafts to move the first and second wipers between the engaged and disengaged positions. The wiper support may include a bearing engaging the arm and the shaft to permit rotation of the shaft relative to the arm to permit movement of the first and second wipers between the first and second orientations. Desirably, there are two arms for moving the first and second wipers between the engaged and disengaged positions, and each arm is secured to one of the shafts. The arms preferably are disposed about the first and second wipers.

In a preferred embodiment, the wiper apparatus further includes a releasable lock for releasably locking each shaft to a respective arm to prevent rotation of the shaft relative to the arm. The releasable lock may, for example, comprise a fastener or other suitable structure coupled to the bearing and movable between a locked position in which the fastener locks the shaft to prevent the shaft from rotating relative to the arm and an unlocked position in which the fastener unlocks the shaft to allow rotation of the shaft relative to the arm.

BRIEF DESCRIPTION OF THE DRAWINGS

The detailed description particularly refers to the accompanying figures in which.

DETAILED DESCRIPTION OF THE DRAWINGS

Figure 1:
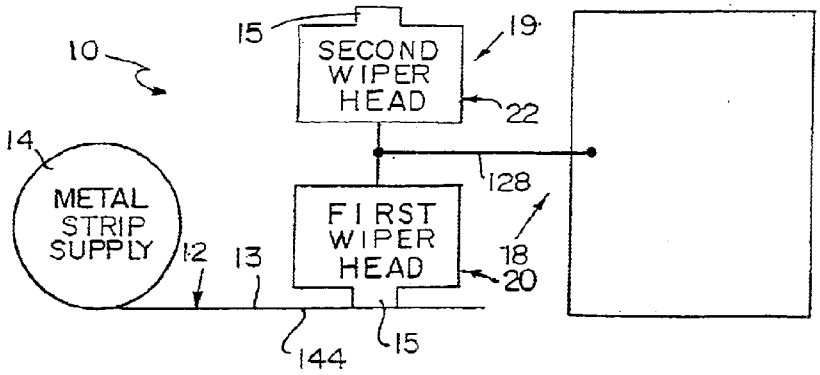
FIG. 1 is a side elevation view, schematic in nature, of a wiper apparatus for wiping liquid coating material on a top surface of a moving strip in accordance with an embodiment of the invention, illustrating the first wiper adjacent the surface of the moving strip for wiping the liquid coating material.
Figure 2:
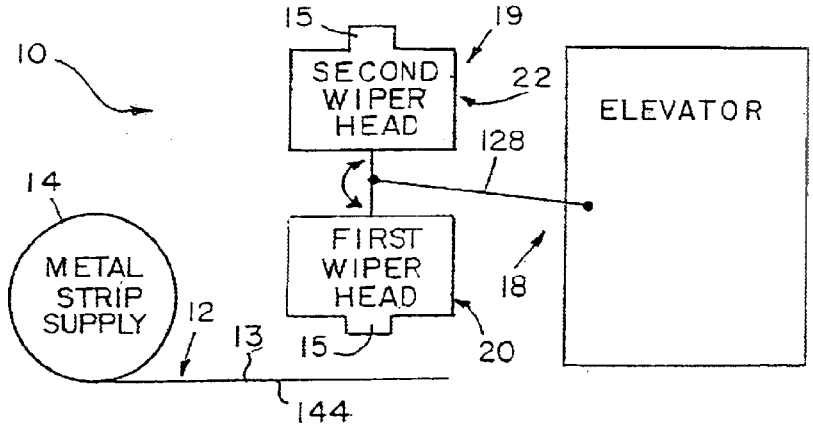
FIG. 2 is a side elevation view, schematic in nature, similar to FIG. 1, illustrating the lift assembly having raised the first and second wipers away from the moving metal strip.

FIGS. 1–11 illustrate a wiper apparatus 10 for wiping excess liquid coating material on a moving metal strip 12 in accordance with an embodiment of the invention. The wiper apparatus 10 wipes liquid coating material that desirably has already been deposited on a surface, such as top surface 13, of the moving strip 12, or that, in accordance with alternative embodiments, is being contemporaneously deposited on the surface of the moving strip, desirably to achieve a uniform coating. The wiping of the liquid coating material on the surface 13 of the moving strip 12 may include spreading or absorbing liquid coating material or both. Depending upon the application, the wiping of the liquid coating material on the surface 13 of the moving strip 12 also may include directing liquid coating material off the surface of the moving strip 12. The moving strip 12 is comprised of metal from a metal strip supply 14, but may comprise any other suitable material in accordance with alternative embodiments of the invention.

The illustrated wiper apparatus 10 comprises generally a pair of wipers 15, a wiper support 16 configured to support the wipers, a frame 17 and a lift assembly 18 for raising and lowering the wiper support. The wipers 15 desirably are made of felt In a preferred embodiment, for example, each wiper 15 is made of F1 hard white felt material available from McMaster-Carr Supply Company located in Chicago, Ill., although other grades of felt material may be suitable for other coating applications. Felt tends to provide an evenly distributed coating on the surface of the moving strip 12 and tends to avoid distortion that may result in an uneven distribution of liquid coating material on the surface of the moving strip. Felt also tends to avoid causing dents on the surface of the moving strip 12, as sometimes occurs when using rolls to remove excess liquid coating material. Felt also tends to be inexpensive. Notwithstanding the benefits of using felt, the wipers may instead comprise any other suitable material in accordance with alternative embodiments of the invention. Each wiper 15 desirably comprises a single integral or unitary strip of material, but may, in accordance with alternative embodiments, instead comprise several strips.

The wiper support 16 may have any suitable configuration. In the embodiment of FIGS. 1–11, for example, the wiper support 16 includes a wiper unit 19 that includes a pair of wiper holders that may, for example, be in the form of wiper heads 20 and 22 for holding respective wipers. The wiper unit 19 further includes first and second rotatable shafts 26 and 28 for moving the wipers 15. In the illustrated embodiment, the wiper heads 20 and 22 define a passageway 116 for receiving the shafts 26 and 28. In accordance with alternative embodiments, the first and second shafts 26 and 38 can be coupled to the wiper heads 20 and 22 in any other suitable manner or instead a single shaft (not shown) can be coupled to the wiper heads 20 and 22.

Figure 4:
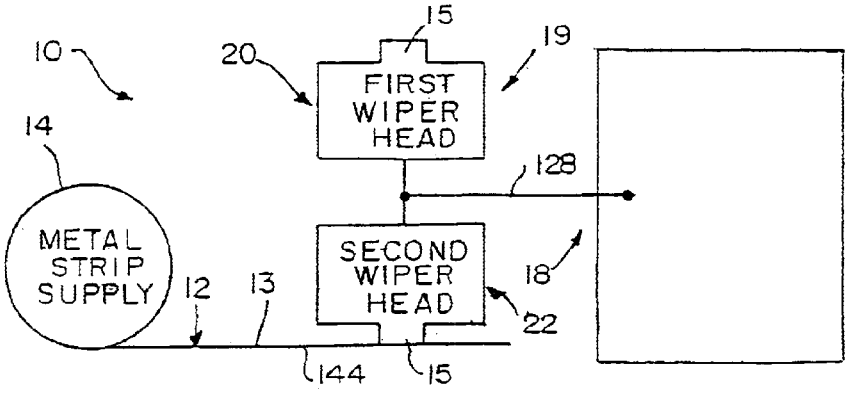
FIG. 4 is a side elevation view, schematic in nature, similar to FIGS. 1–3, illustrating the arms of the lift assembly having lowered the first and second wipers toward the surface of the moving strip so that the second wiper is adjacent the surface of the moving strip for wiping the liquid coating material.

First and second wiper heads 20, 22 are configured to move to an active or deployed, lowered position in alternating fashion so that a respective wiper 15 is adjacent a top surface 13 of the metal strip to wipe liquid coating material on surface 13, as shown in FIGS. 1 and 4, for example. When one of first and second wiper heads 20, 22 is positioned to lie in the deployed or lowered position, the other wiper head 20, 22 and a respective wiper 15 are spaced from the moving strip 12 desirably in an inactive or remote, upper position, for changing the respective wiper 15 or for any other maintenance, for example. In the illustrated embodiment, for example, the wiper heads are 180° out of phase. First and second wiper heads 20, 22 desirably can be alternately moved between the active and inactive positions easily while the production line of moving strip 12 continues so as to require no downtime on the production line.

First and second wiper shafts 26, 28 cooperate to define a central longitudinal axis 30 of wiper unit 19. First and second wiper heads 20,22 desirably are fixed to first and second wiper shafts 26, 28 for rotation about central longitudinal axis 30. Wiper unit 19 may, for example, be made of easily obtainable structural steel shapes which are simple to fabricate. References to various radial and axial relationships hereinafter are made with respect to central longitudinal axis 30.

If desired, the wiper apparatus 10 may include a lift assembly 18 configured to lift or move wiper unit 19 relative to the moving strip between an engaged position in which one of the wiper heads 20 and 22 is in the active position and a disengaged position in which both of the wiper heads are spaced from the moving strip. With this embodiment, when the wiper unit 19 is in the disengaged position, the wiper shafts 26 and 28 can be rotated, manually or otherwise, to move and thereby alternate the wiper heads 20 and 22 so that one of the two is ready to be placed in an in the deployed or active position and the other of the two is ready to be placed in the inactive position. After rotation of the shafts 26 and 28, the lift assembly 18 moves the wiper unit 19 back into the engaged position so that one of the wiper heads 20 and 22 is in the deployed or active position. Thus, moving the wiper unit 19 to the disengaged position allows re-positioning of the wiper heads 20 and 22. If desired, the wiper unit 19 can be moved to the disengaged position for other reasons such as, for example, to avoid causing damage to respective wiper 15 when a splice in moving metal strip 12 that "stitches" two metal strip supply coils together passes wiper unit 19.

Figure 5:
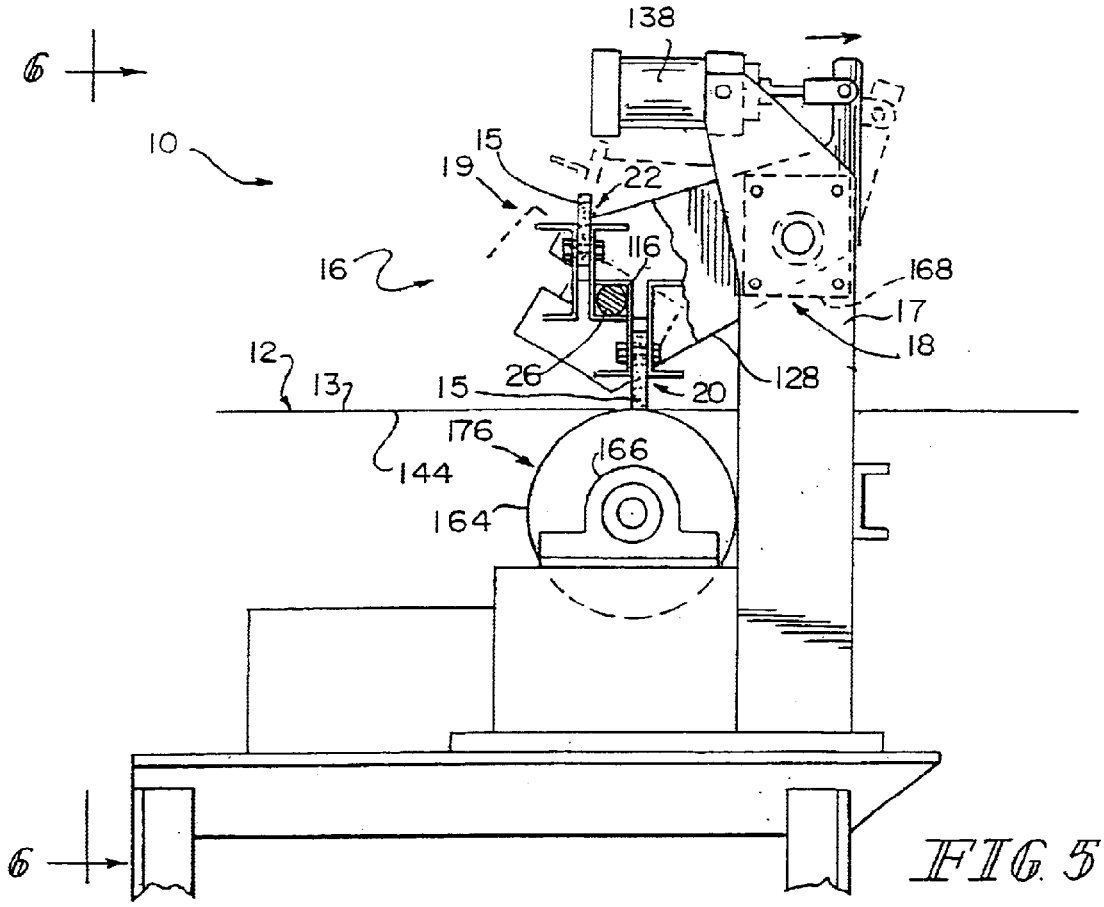
FIG. 5 is a side elevation view of the wiper apparatus of FIG. 1, with portions cut away, showing in solid lines the lift assembly positioning the wipers so that the first wiper contacts the surface of the moving strip and showing in dashed lines the lift assembly having raised the wipers away from the moving metal strip.
Figure 6:
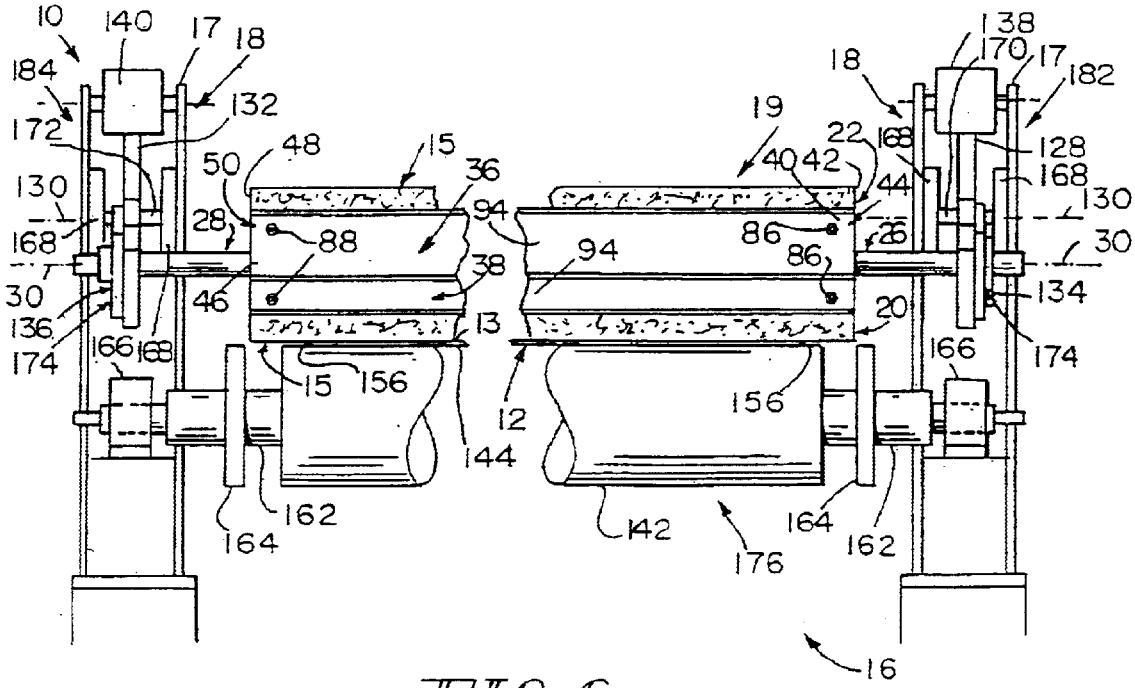
FIG. 6 is a front elevation view of the wiper apparatus of FIG. 5 taken along line 6—6.
Figure 10:
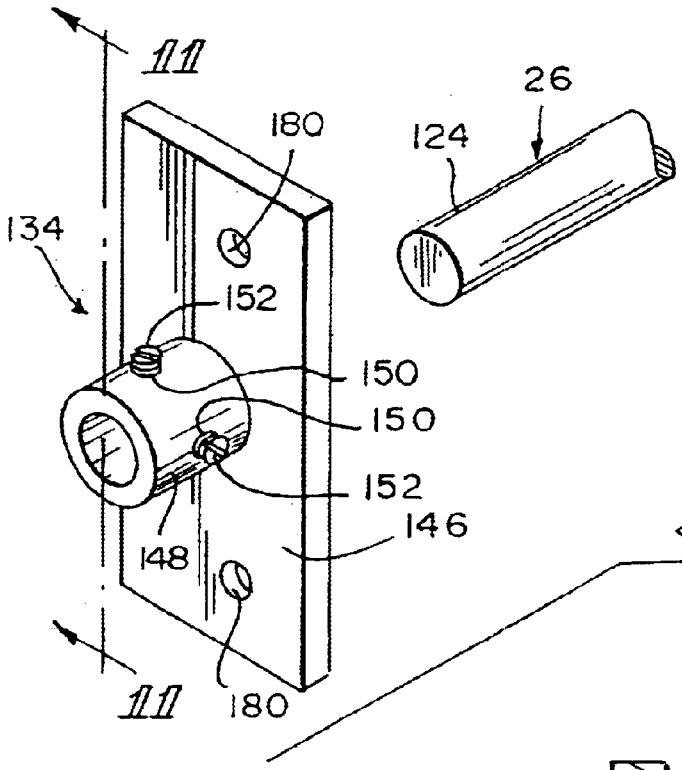
FIG. 10 is an exploded perspective and broken view of an end mount sized to receive a shaft of the wiper apparatus of FIG. 9.
Figure 11:
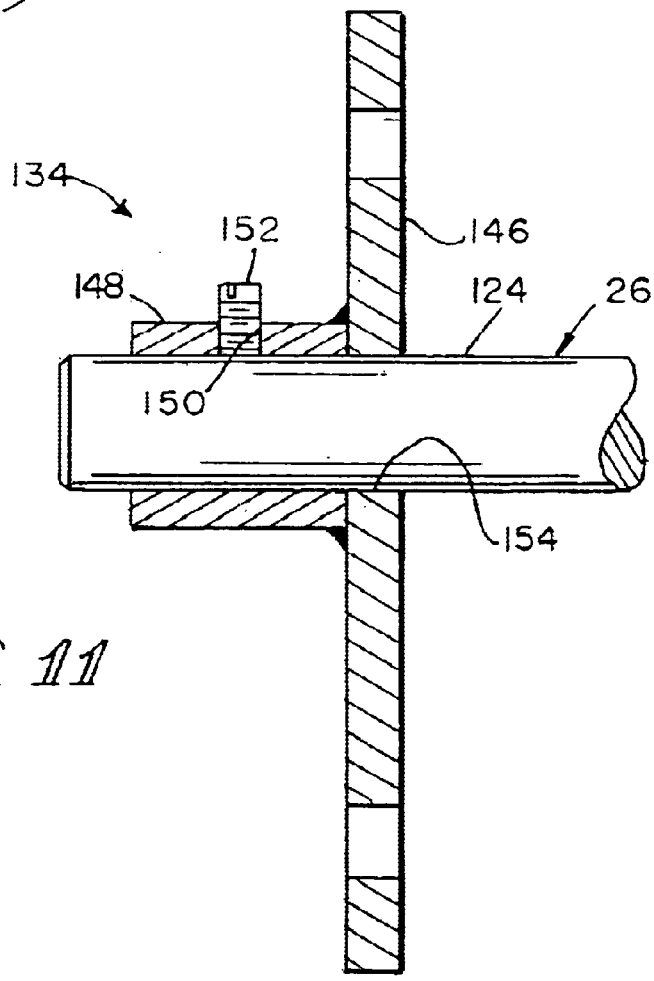
FIG. 11 is a section view of the end mount of FIG. 10 taken along line 11—11.

Lift assembly 18 can have any suitable construction and manner of operation. In the illustrated embodiment, for example, lift assembly 18 includes a pair of arms 128, 132 disposed about the wipers 15 for raising and lowering the wiper heads 20 and 22. The illustrated arms 128, 132 move central longitudinal axis 30 of wiper unit 19 in an arcuate fashion with respect to an arm axis 130 of lift assembly between the engaged and disengaged positions. Lift assembly 18 includes first and second actuators 138, 140 mounted on frame 17, arm shaft bearings 168 fixed to frame 17, first and second arm shafts 170, 172 coupled to arm shaft bearings 168 for rotation, and first and second arms 128, 132 coupled to rotation support 174, respective actuator 138, 140, and respective arm shaft 170, 172, as shown in FIGS. 5–6, for example. First actuator 138 is coupled to frame 17 and first arm 128 to rotate first arm 128 about arm axis 130. Similarly, second actuator 140 is coupled to frame 17 and second arm 132 to rotate second arm 132 about arm axis 130. Lift assembly 18 includes a rotation support 174 coupled to wiper unit 19 to support wiper unit 19 for rotation, as shown in FIGS. 6 and 10–11, for example.

First arm 128 is coupled to first actuator 138 and first arm shaft 170 for rotation about arm axis 130 and coupled to rotation support 174 to move wiper unit 19 between the lowered and raised positions. Similarly, second arm 132 is coupled to second actuator 140 and second arm shaft 172 for rotation about arm axis 130 and coupled to rotation support 174 to move wiper unit 19 between the lowered and raised positions.

Rotation support 174 of wiper apparatus 10 is coupled to wiper unit 19 to support wiper unit 19 for rotation, as shown in FIG. 6, for example. Rotation support 174 includes a first wiper bearing or end mount 134 fixed to a plate of first arm 128 and a second wiper bearing or end mount 136 fixed to a plate of second arm 132. First wiper shaft 26 extends through the plate of first arm 128 and first end mount 134 so that first wiper shaft 26 is coupled to first end mount 134 for lockable and bearing engagement, as shown in FIGS. 10–11, for example. Similarly, second wiper shaft 28 extends through the plate of second arm 132 and second end mount 136 so that second wiper shaft 26 is coupled to second end mount 136 for lockable and bearing engagement. First end mount 134 is part of first arm 128 and second end mount 136 is part of second arm 132.

The illustrated lift assembly 18 includes a first lift assembly unit 182 and a second lift assembly unit 184, as shown, for example, in FIG. 6. First actuator 138, one of arm shaft bearings 168, first arm shaft 170, first arm, and first end mount 134 cooperate to define first lift assembly unit 182. Second actuator 140, the other of arm shaft bearings 168, second arm shaft 172, second arm 132, and second end mount 136 cooperate to define second lift assembly unit 184.

Wiper apparatus 10 may further include a roll unit 176, as shown in FIG. 6, for example. Roll unit 176 includes roll shaft bearings 166 coupled to frame 17, a roll shaft 162 coupled to roll shaft bearings 166 for rotation, a roll 142 coupled to roll shaft 162 for rotation, and a pair of slingers 164 coupled to roll shaft 162. Roll 142 is positioned to lie below moving metal strip 12 to contact a bottom surface 144 of moving metal strip 12. Roll 142 supports moving metal strip 12 to provide a flat surface against which a wiper 15 of the operational wiper head presses. In doing so, roll 142 also helps to prevent moving metal strip 12 from cutting into wiper 15 as moving metal strip 12 tracks back and forth along the length of wiper 15. Slingers 164 prevent liquid coating material on roll shaft 162 from reaching roll shaft bearings 166 or wiper apparatus 10.

The structure and function of first and second wiper heads 20, 22 desirably are substantially similar to one another. Thus, the description of first wiper head 20 applies to second wiper head 22 and like reference numerals refer to like structures, except as otherwise noted.

Figure 7:
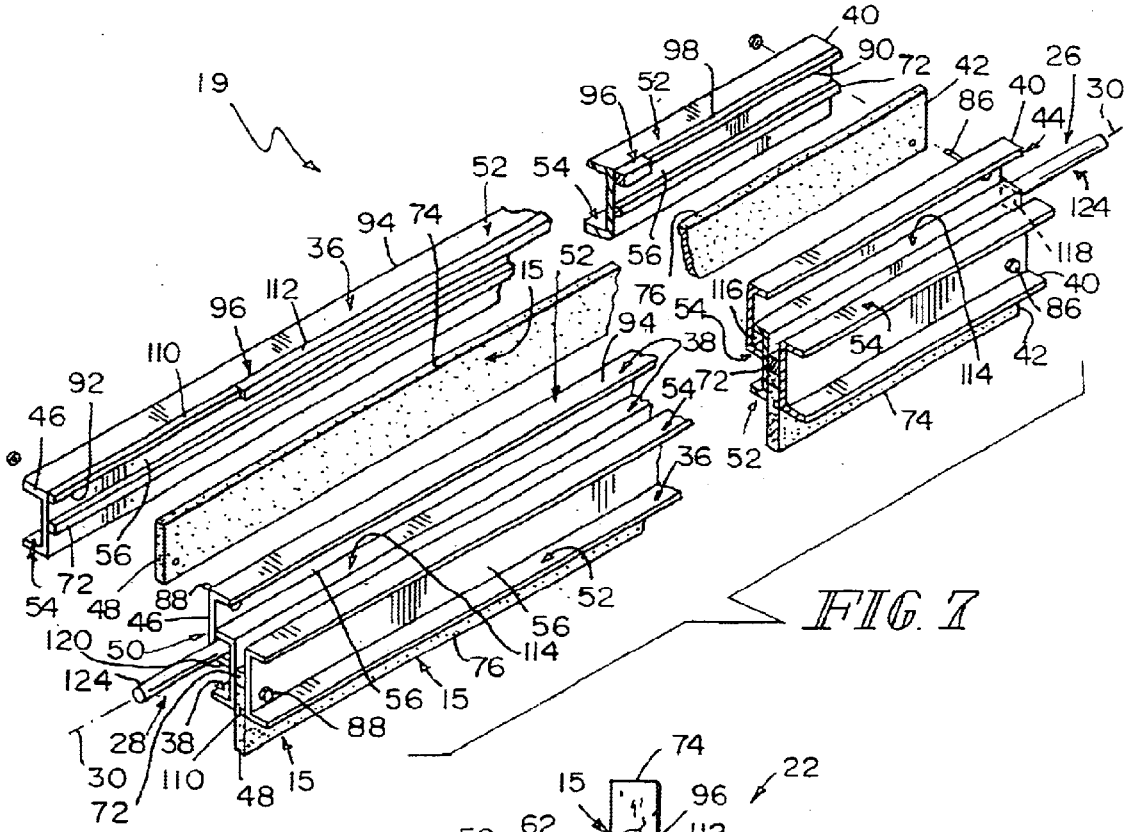
FIG. 7 is a partially exploded perspective view of components of the first and second wiper support of FIGS. 5 and 6, including the first and second wipers and wiper heads and the shafts secured to the first and second wiper heads.
Figure 8:
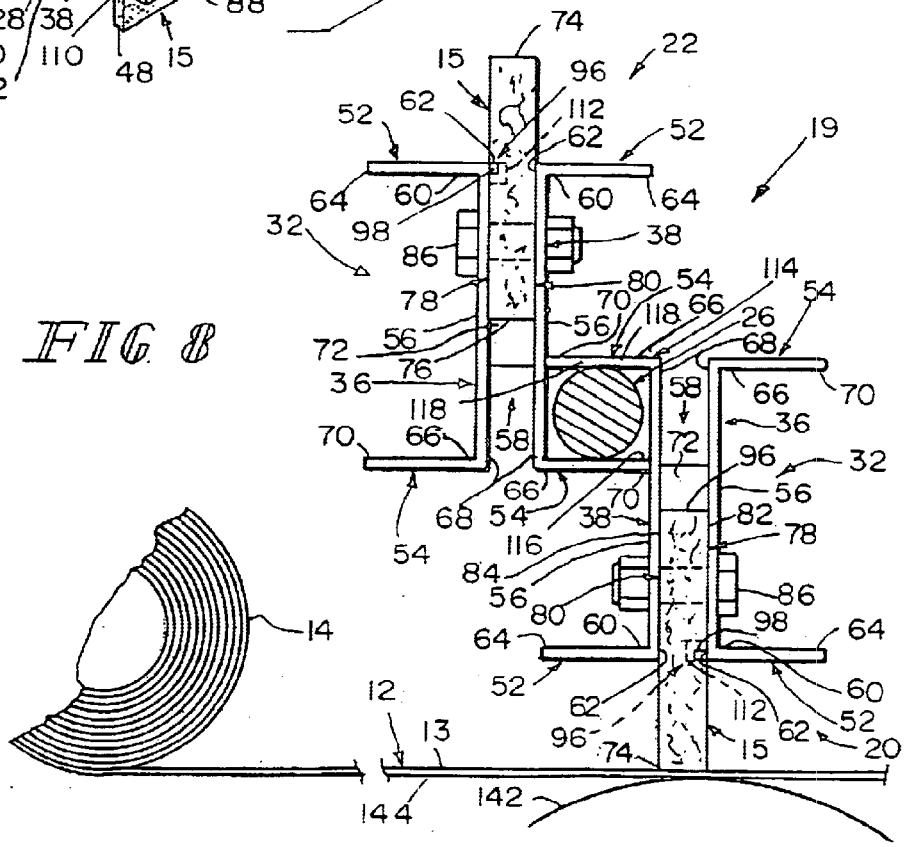
FIG. 8 is a side elevation view of the wiper apparatus of FIG. 7, illustrating the first wiper adjacent the surface of the moving strip and the second wiper spaced apart from the surface of the moving strip.
Figure 9:
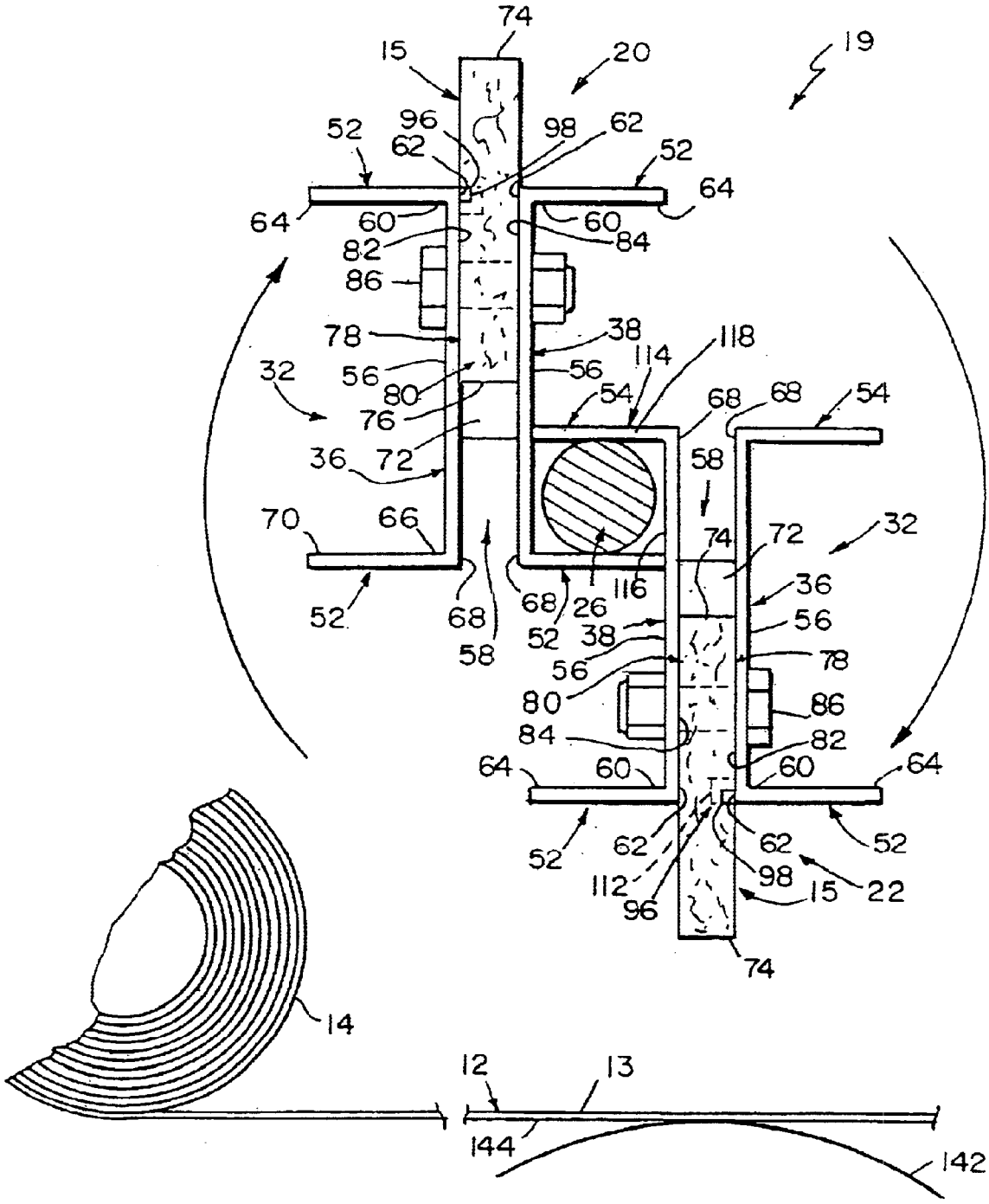
FIG. 9 is a side elevation view of the wiper apparatus of FIG. 8 illustrating the first and second wipers moved away from the surface of the moving strip and having been rotated so that the second wiper is closer to the surface of the moving strip than the first wiper.

The illustrated first wiper head 20 includes a clamp 32 engaging or holding wiper 15, as shown in FIGS. 7–9, for example. Clamp 32 includes a C-shaped radially outer support 36 and a C-shaped radially inner support 38. Wiper 15 is sandwiched between outer and inner supports 36, 38 to engage top surface 13 of moving metal strip 12 to remove excess liquid coating material from top surface 13 of moving metal strip 12 and smooth liquid coating material thereon. Outer and inner supports 36, 38 are positioned to lie in spaced-apart, oppositional relation to one another.

An axial first end 40 of clamp 32 and an axial first end 42 of felt wiper 15 are positioned to lie in substantially co-terminus relation with one another and cooperate to define an axial first end 44 of first wiper head 20, as shown in FIGS. 6–7, for example. Similarly, an axial second end 46 of clamp 32 and an axial second end 48 of wiper 15 are positioned to lie in substantially co-terminus relation with one another and cooperate to define an axial second end 50 of first wiper head 20. (Reference numerals 40, 46 also refer herein to an axial first end of outer and inner supports 36, 38 and an axial second end of outer and inner supports 36, 38, respectively, as outer and inner supports 36, 38 are part of clamp 32.) First and second ends 40, 46 of clamp 32 and first and second ends 42, 48 of wiper 15 are positioned to lie outside edges 156 of moving metal strip 12 so that first wiper head 20 extends across the width of moving metal strip 12 and beyond edges 156.

Each of outer and inner supports 36, 38 is formed to include a radially outer flange 52, a radially inner flange 54, and a wall 56 extending therebetween, as shown in FIGS. 7–9, for example. Outer and inner flanges 52, 54 and walls 56 of clamp 32 of first wiper head 20 extend from first end 40 to second end 46 of respective support 36, 38. Outer and inner flanges 52, 54 of respective support 36, 38 are positioned to lie in spaced-apart parallel relation to one another and in perpendicular relation to respective wall 56. Walls 56 of clamp 32 of first wiper head 20 are positioned to lie in spaced-apart, parallel relation to one another so as to form a gap 58 therebetween.

Outer flanges 52 are positioned to lie in planar relation to one another and extend from respective wall 56 away from one another. Each outer flange 52 includes a proximal end 60 fixed to a radially outer end 62 of wall 56 of respective support 36, 38 and a distal end 64 spaced apart from proximal end 60 of outer flange 52.

Inner flanges 54 are positioned to lie in planar relation to one another and extend from respective wall 56 away from one another. Each inner flange 54 includes a proximal end 66 fixed to a radially inner end 68 of wall 56 of respective support 36, 38 and a distal end 70 spaced apart from proximal end 66 of inner flange 54.

Clamp 32 of first wiper head 20 further includes a stopper 72 welded to wall 56 of outer support 36 between outer and inner ends 62, 68 of wall 56 of outer support 36 to fix stopper 72 between outer and inner supports 36, 38 in gap 58, as shown in FIGS. 7–9, for example. Stopper 72 is positioned to abut wall 56 of inner support 38 thereby bridging gap 58 between walls 56 of outer and inner supports 36, 38. Stopper 72 extends from first end 40 of clamp 32 to second end 46 of clamp 32 so that stopper 72 is substantially co-terminus with outer and inner supports 36, 38 and wiper 15. In illustrative embodiments, stopper 72 is made of ⅝ inch keystock material.

Wiper 15 is positioned to lie in gap 58 between walls of clamp 32 of first wiper head 20 in abutting engagement with stopper 72 of clamp 32 of first wiper head 20, as shown in FIGS. 7–9, for example. Wiper 15 includes a wiping surface or radially outer end 74, a radially inner end 76, a radially outer surface 78, and a radially inner surface 80. Outer end 74 of wiper 15 is positioned to lie spaced apart from outer and inner supports 36, 38 of first wiper head 20 to contact top surface 13 of moving metal strip 12 to remove excess liquid coating material therefrom and smooth liquid coating material thereon when first wiper head 20 is in the deployed, lowered position. Inner end 76 of wiper 15 is positioned to abut stopper 72 and to lie in spaced-apart relation to outer end 74 of wiper 15.

Outer and inner surfaces 78, 80 of wiper 15 extend from outer end 74 of wiper 15 beyond outer ends 62 of walls 56 to inner end 76 of wiper 15. A portion 82 of outer surface 78 of wiper 15 abuts wall 56 of outer support 36. Similarly, a portion 84 of inner surface 80 of wiper 15 abuts wall 56 of inner support 38.

Clamp 32 of first wiper head 20 further includes first and second fasteners 86, 88 configured to fasten wiper 15 to outer and inner supports 36, 38 of clamp 32 of first wiper head 20 at first and second ends 40, 46 of clamp 32, as shown in FIGS. 7–9, for example. Fasteners 86, 88 compress wiper 15 between walls 56 of outer and inner supports 36, 38.

Outer and inner supports 36, 38 are each formed to include a first aperture 90 sized to receive first and second fasteners 86, 88 and positioned to lie at first end 40 of respective support 36, 38, as shown in FIG. 7, for example. Outer and inner supports 36, 38 further include a second aperture 92 sized to receive second fastener 88 and positioned to lie at second end 46 of respective support 36, 38. First fastener 86 extends through first apertures 90 of outer and inner supports 36, 38 and through wiper 15. Second fastener 88 extends through second apertures 92 of outer and inner supports 36, 38 and through wiper 15.

Fasteners 86, 88 are positioned at first and second ends 40, 46 of clamp 32 such that fasteners 86, 88 are positioned to lie outside edges 156 of moving metal strip 12, as shown in FIG. 6, for example. This is so that an operator can change wiper 15 away from moving metal strip 12. Using only one fastener on each end 40, 46 of clamp 32 enables the operator to change wiper 15 quickly in minutes. In illustrative embodiments, each fastener 86, 88 includes a bolt that extends through wiper 15 and respective apertures 90, 92. In other illustrative embodiments, each fastener 86, 88 includes a hand-operated clamp (not shown) that similarly extends through wiper 15 and respective apertures 90, 92.

When wiper 15 is inserted between walls 56 of outer and inner supports 36, 38 and fasteners 86, 88 fasten wiper 15 to outer and inner supports 36, 38 at ends 40, 46 of clamp 32, outer and inner supports 36, 38 tend to bow outwardly. The degree of bowing is greater toward middle portions 94 of outer and inner supports 36, 38 than toward first and second ends 40, 46 of outer and inner supports 36, 38. Stated otherwise, middle portions 94 of outer and inner supports 36, 38 are positioned to lie farther away from one another than first ends 40 of outer and inner supports 36, 38 are positioned to lie away from one another and second ends 46 of outer and inner supports 36, 38 are positioned to lie away from one another.

Clamp 32 of first wiper head 20 further includes a bar or lug 96 fixed to outer end 62 of wall 56 of outer support 36 to grip wiper 15 (i.e., press wiper 15 toward inner support 38) when wiper 15 is fastened in clamp 32 of first wiper head 20, as shown in FIGS. 7–9, for example. Lug 96 is configured to compensate for the bowing that develops in outer and inner supports 36, 38 when wiper 15 is fastened to outer and inner supports 36, 38 at ends 40, 46 of clamp 32. Lug 96 extends from first end 40 of outer support 36 to second end 46 of outer support 36. Lug 96 is welded to wall 56 of outer support 36 and extends away from wall 56 of outer support 36 toward wall 56 of inner support 38.

Lug 96 includes a first axially outer smaller bar or lug 98, a second axially outer smaller bar or lug 110, and an axially middle larger bar or lug 112 positioned to lie therebetween, as shown in FIGS. 7–9, for example. First outer lug 98 extends from first end 40 of outer support 36 to middle larger lug 112. Middle lug 112 extends from first outer smaller lug 98 to second outer smaller lug 110. Second outer smaller lug 110 extends from middle larger lug 112 to second end 46 of outer support 36. Outer and middle lugs 98, 110, 112 are welded to wall of outer support 36 and extend away from wall 56 of outer support 36 toward wall 56 of inner support 38. In illustrative embodiments, outer smaller lugs 98, 110 are made of ⅛ inch keystock material and middle larger lug 112 is made of ¼ inch keystock material Middle larger lug 112 is larger in cross-section than either of first and second outer smaller lugs 98, 110, which have substantially the same size in cross-section and length. Middle larger lug 112 extends farther away from wall 56 of outer support 36 toward wall 56 of inner support 38 than outer smaller lugs 98, 110 to compensate for the greater bowing that develops toward middle portions 94 of outer and inner supports 36, 38 than toward first and second ends 40, 46 of outer and inner supports 36, 38.

Inner supports 38 of clamps 32 of first and second wiper heads 20, 22 are fixed to one another, as shown in FIGS. 7–9, for example. Distal end 70 of inner flange 54 of inner support 38 of first wiper head 20 is welded to wall 56 of inner support 38 of second wiper head 22. Similarly, distal end 70 of inner flange 54 of inner support 38 of second wiper head 22 is welded to wall 56 of inner support 38 of first wiper head 20. Inner flanges 54 of inner supports 38 of first and second wiper heads 20, 22 are positioned to lie in spaced-apart, parallel relation to one another. Walls 56 of inner supports 38 of first and second wiper heads 20, 22 are positioned to lie in spaced-apart, parallel relation to one another. Wall 56 of inner support 38 of first wiper head 20 is positioned to lie in perpendicular relation to inner flange 54 of inner support 38 of second wiper head 22. Similarly, wall 56 of inner support 38 of second wiper head 22 is positioned to lie in perpendicular relation to inner flange 54 of inner support 38 of first wiper head 20.

Coupled together in this way, inner supports 38 of first and second wiper heads 20, 22 cooperate to form a box beam or hollow support tube 114 of rectangular cross-section that provides strength to wiper unit 19, as shown in FIGS. 7–9, for example. Support tube 114 defines a passageway sized to receive first and second wiper shafts 26, 28. Support tube 114 is formed to include an axial first open end 118 and an axial second open end 120. Support tube 114 extends from first ends 40 of inner supports 38 of first and second wiper heads 20, 22 to second ends 46 of inner supports 38 of first and second wiper heads 20, 22.

First and second wiper shafts 26, 28 extend into passageway 116, as shown in FIGS. 7–9, for example. Bach of first and second wiper shafts 26, 28 includes an axially inner portion (not shown) and an axially outer portion 124. The inner portion of first wiper shaft 26 extends through first open end 118 of support tube 114 into passageway 116 and is welded to inner flanges 54 of inner supports 38 so that the inner portion of first wiper shaft 26 is positioned to lie within passageway 116. Similarly, the inner portion of second wiper shaft 28 extends through second open end 120 of support tube 114 into passageway 116 and is welded to inner flanges 54 of inner supports 38 so that the inner portion of second wiper shaft 28 is positioned to lie within passageway 116.

Each of first and second end mounts 134, 136 includes a plate 146 and a bushing 148 welded to respective plate 146, as shown in FIGS. 10–11. Each bushing 148 includes a pair of apertures 150 each of which is sized to receive a fastener or setscrew 152. Outer portion 124 of first wiper shaft 26 extends through a central aperture 154 defined by plate 146 of first end mount 134 into bushing 148 so that outer portion 124 is positioned to lie within plate 146 and bushing 148 of first end mount 134. Similarly, outer portion 124 of second wiper shaft 28 extends through central aperture 154 of plate 146 of second end mount 136 into bushing 148 of second end mount 136 so that outer portion 124 of second wiper shaft 28 is positioned to lie within plate 146 and bushing 148 of second end mount 136. Plate 146 further includes a pair of offset apertures 180 sized to receive a respective fastener (not shown) to fix plate 146 to respective arm 128, 132.

A setscrew 152 is positioned to lie within each aperture 150 of each bushing 148 for lockable engagement with respective wiper shaft 26, 28, as shown in FIG. 11, for example. Setscrews 152 within bushing 148 of first end mount 134 are positioned to engage outer portion 124 of first wiper shaft 26 to fasten first wiper shaft 26 to first end mount 134 during operation of wiper unit 19. Setscrews 152 within bushing 148 of first end mount 134 can be backed away from outer portion 124 of first wiper shaft 26 so that they are positioned to lie spaced apart from outer portion 124 of first wiper shaft 26 to permit rotatable movement of outer portion 124 of first wiper shaft 26 within bushing 148 and plate 146 of first end mount 134.

Similarly, setscrews 152 within bushing 148 of second end mount 136 are positioned to engage outer portion 124 of second wiper shaft 28 to fasten second wiper shaft 28 to second end mount 136 during operation of wiper unit 19. Setscrews 152 within bushing 148 of second end mount 136 can be backed away from outer portion 124 of second wiper shaft 28 so that they are positioned to lie space apart from outer portion 124 of second wiper shaft 28 to permit rotation of outer portion 124 of second wiper shaft 28 within bushing 148 and plate 146 of second end mount 136. Rotation of outer portions 124 of first and second wiper shafts 26, 28 in turn causes rotation of wiper unit 19 about central longitudinal axis 30.

Figure 3:
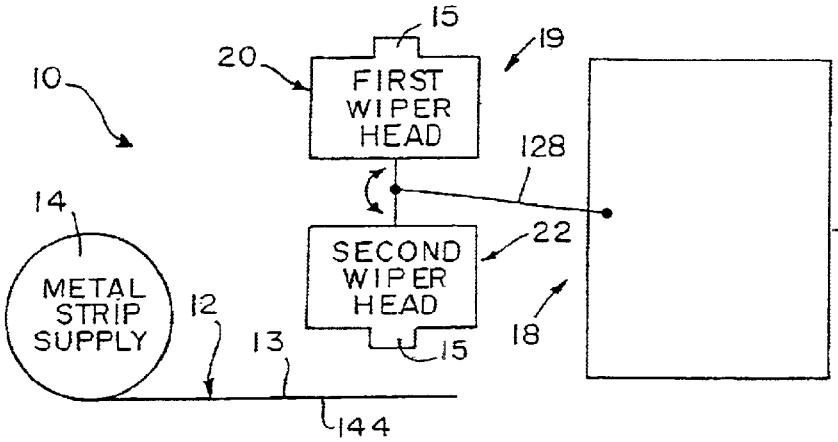
FIG. 3 is a side elevation view, schematic in nature, similar to FIGS. 1 and 2, illustrating movement of the first and second wipers to alternate positions.

Setscrews 152 may be loosened to enable first and second wiper shafts 26, 28 to rotate within first and second end mounts 134, 136, respectively, to rotate wiper unit 19 about central longitudinal axis 30. After loosening setscrews 152, an operator rotates wiper unit 19 180° manually to move first wiper head 20 from the deployed, raised position to the remote raised position and to move second wiper head 22 from the remote, raised position to the deployed, raised position, as shown in FIGS. 3 and 9, for example.

Setscrews 152 may then be re-tightened to lock first and second wiper heads 20, 22 in their new positions. After re-tightening setscrews 152, lift assembly 18 lowers wiper unit 19 to the lowered position so that first wiper head 20 is in the remote, lowered position and second wiper head 22 is in the deployed, lowered position in contact with top surface 13 of moving metal strip 12, as shown in FIG. 4, for example, thereby completing the switch of the operational wiper head from first wiper head 20 to second wiper head 22. Switching the operational wiper head from second wiper head 22 to first wiper head 20 follows the process just described in reverse.

Figure 12:
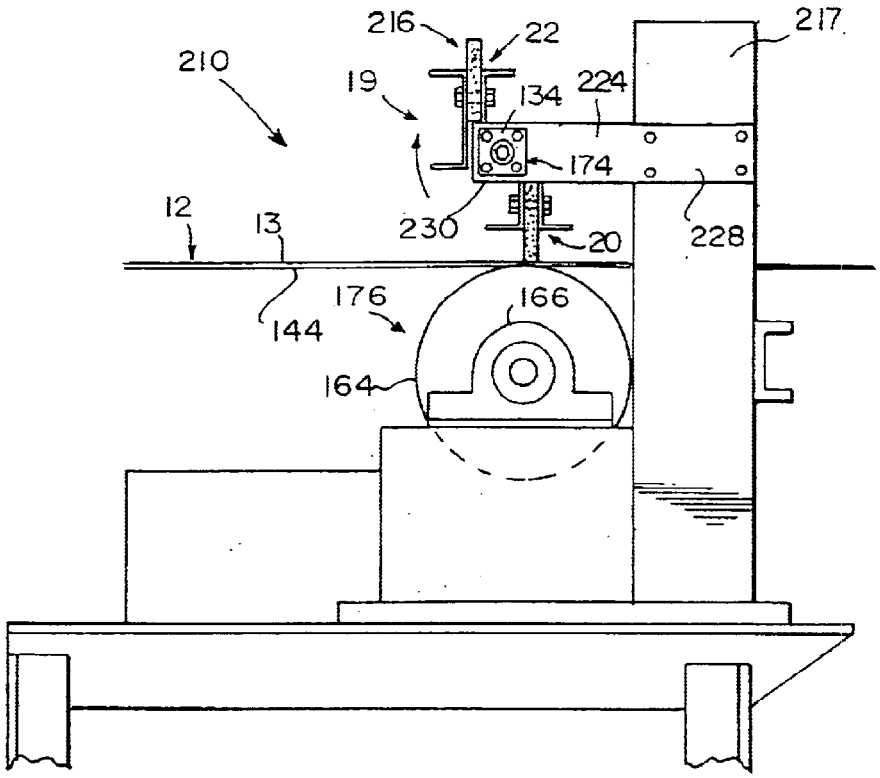
FIG. 12 is a side elevation view of a coating wiper apparatus in accordance with an other embodiment of the invention, including a pair of wipers similar to the wipers of FIG. 8, and illustrating the wipers being coupled to a stationary support arm which is fixed to a frame and extends horizontally away from the frame to support the wipers.

A coating wiper apparatus 210 is shown in FIG. 12, for example. Coating wiper apparatus 210 is similar to coating wiper apparatus 10 so that like reference numerals refer to like structures, except as otherwise noted. Coating wiper apparatus 210 includes a wiper support 216 having wiper unit 19 including first and second wiper heads 20, 22. Wiper unit 19 is supported continuous contact with moving metal strip 12 except when wiper unit 19 is rotated about central longitudinal axis 30. Wiper heads 20, 22 engage or otherwise hold wipers 15.

Wiper apparatus 210 includes roll unit 176, a frame 217, a first support arm 224, and a second support arm (not shown) which is like first support arm 224. First support arm 224 and the second support arm are fixed to frame 217 against movement relative thereto. First support arm 224 and the second support arm include a proximal end 228 bolted to frame 217 and a distal end 230 spaced apart from frame 217.

Wiper apparatus 210 includes rotation support 174 which includes first end mount 134 and second end mount 136. First end mount 134 is fixed to distal end 230 of first support arm 224. Second end mount 136 is fixed to distal end 230 of the second support arm. First and second wiper shafts 26, 28 of wiper unit 19 extend through respective support arm to couple to first and second end mounts 134, 136, respectively, in the previously discussed manner.

Frame 217, first support arm 224, and the second support arm cooperate to maintain central longitudinal axis 30 of wiper unit 19 stationary so that wiper unit 19 undergoes no translational movement. Wiper unit 19 can be manually rotated around central longitudinal axis 30, as discussed above with respect to wiper apparatus 10, to switch the operational wiper head between first and second wiper heads 20, 22. Frame 217 and first support arm 224 and the second support arm maintain the operational wiper head in continuous contact with moving metal strip 12, except when the operational wiper head is being switched between first and second wiper heads 20, 22.

Wiper apparatus 210 can be used, for example, when the splices between successive metal strip supply coils are welded together to form a smooth connection therebetween. The smooth welded connection avoids damaging wiper 15 of the operational wiper head even though wiper 15 remains in contact with moving metal strip 12 when the splices pass through wiper apparatus 210.

Figure 13:
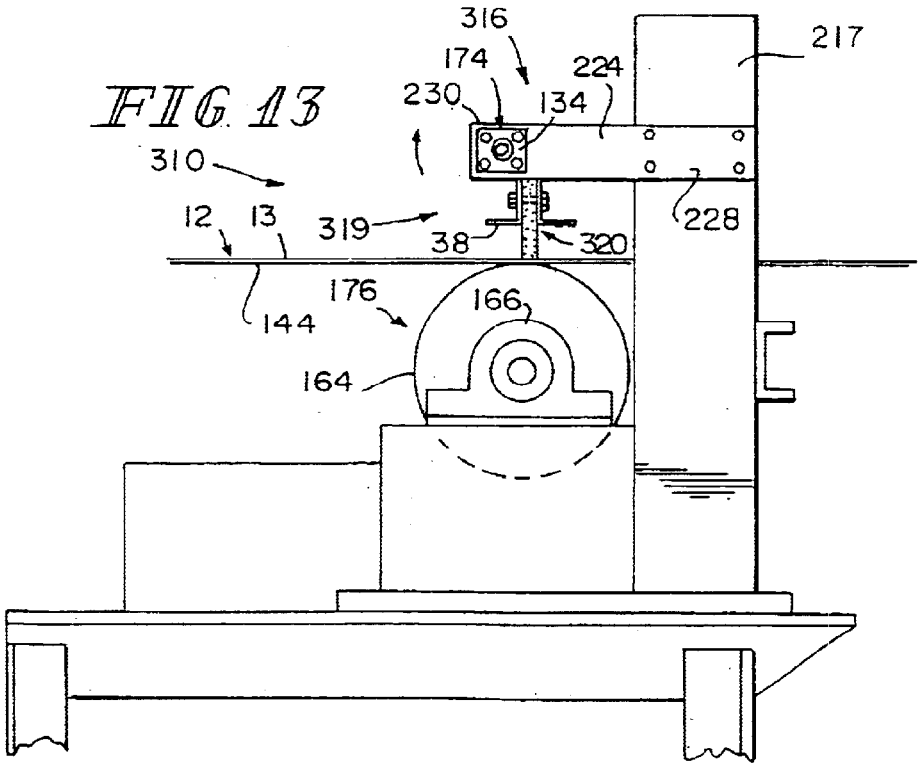
FIG. 13 is a side elevation view of a coating wiper apparatus in accordance with a further embodiment of the invention having a single wiper head coupled to a stationary support arm.

A coating wiper apparatus 310 is shown in FIG. 13, for example. Coating wiper apparatus 310 is similar to coating wiper apparatus 10 and 210 so that like reference numerals refer to like structures, except as otherwise noted.

Coating wiper apparatus 310 includes a wiper support having a wiper unit 319. Wiper unit 319 is similar to wiper unit 19 except that wiper unit 319 has a single wiper head 320, which is similar to each of wiper heads 20, 22. Inner support 38 of wiper head 320 is welded to each of first and second wiper shafts 26, 28 of wiper unit 319. Wiper apparatus 310 supports wiper head 320 of wiper unit 319 in continuous contact with moving metal strip 12, except when wiper head 320 is rotated away from moving metal strip 12.

Coating wiper apparatus 310 includes first support arm 224, a second support arm (not shown) which is like first support arm 224 (similar to coating apparatus 210), and rotation support 174 which includes first end mount 134 and second end mount 136. First end mount 134 is fixed to distal end 230 of first support arm 224. Second end mount 136 is fixed to distal end 230 of the second support arm. First and second wiper shafts 26, 28 of wiper unit 319 extend through respective support arm to couple to first and second end mounts 134, 136, respectively, in the previously discussed manner.

Frame 217, first support arm 224, and the second support arm cooperate to maintain central longitudinal axis 30 of wiper unit 319 stationary so that wiper unit 319 undergoes no translational movement. Wiper unit 319 can be manually rotated around central longitudinal axis 30, as discussed above with respect to coating apparatus 10, to move wiper head 320 into and out of contact with moving metal strip 12 to service wiper head 320, for example. Frame 217, first support arm 224, and the second support arm maintain wiper head 320 in continuous contact with moving metal strip 12, except when wiper head 320 is moved out of contact with moving metal strip 12.

Similar to coating wiper apparatus 210, coating wiper apparatus 310 can be used when the splices between successive metal strip supply coils are welded together to form a smooth connection therebetween, for example. The smooth welded connection avoids damaging wiper 15 of wiper head 320 even though wiper 15 remains in contact with moving metal strip 12 when the splices pass through coating wiper apparatus 310.

Wiper units 19 and 319 require little maintenance. Wiper 15 is changed periodically as required. Wiper units 19 and 319 include no bearings or slides. Thus, no greasing of wiper units 19 and 319 is needed.

Although the invention has been described in detail with reference to illusive embodiments, variations and modifications exist within the scope and spirit of the invention as recited in the following claims.

What is claimed is:

1. A wiper apparatus for wiping liquid coating material on a surface of a moving strip, the wiper apparatus comprising:

first and second wipers, each wiper for alternately wiping the liquid coating material on the surface of the moving strip;

a wiper support coupled to the first and second wipers for moving the first and second wipers between a first orientation wherein the first wiper is adjacent the surface of the moving strip for wiping the liquid coating material on the surface of the moving strip and the second wiper is spaced from the surface of the moving strip, and a second orientation wherein the second wiper is adjacent the surface of the moving strip for wiping the liquid coating material on the surface of the moving strip and the first wiper is spaced from the surface of the moving strip; and a lift assembly arranged to move the first and second wipers between an engaged position in which the first and second wipers are in one of the first and second orientations and a disengaged position in which both of the first and second wipers are spaced from the surface of the moving strip.

2. The wiper apparatus of claim 1 wherein the first wiper and the second wiper comprise felt.

3. The wiper apparatus of claim 1 wherein the wiper support includes at least one shaft coupled to at least one of the first and second wipers, the shaft rotatable to move the first and second wipers between the first and second orientations.

4. The wiper apparatus of claim 3 further including a releasable lock for preventing rotation of the shaft.

5. The wiper apparatus of claim 3 wherein the wiper support further includes first and second wiper holders, at least one of which is secured to the shaft, the first wiper holder secured to the first wiper and the second wiper holder secured to the second wiper.

6. The wiper apparatus of claim 5 wherein at least one of the first and second wiper holders defines a passageway receiving the shaft.

7. The wiper apparatus of claim 3 wherein there are two shafts.

8. The wiper apparatus of claim 1 further comprising at least one arm for moving the first and second wipers between the engaged position and the disengaged position.

9. The wiper apparatus of claim 8 wherein the wiper support includes at least one shaft coupled to at least one of the first and second wipers, the shaft rotatable to move the first and second wipers between the first and second orientations, the arm being coupled to the shaft to move the first and second wipers between the engaged and disengaged positions.

10. The wiper apparatus of claim 9 wherein the wiper support includes a bearing engaging the arm and the shaft to permit rotation of the shaft relative to the at least one arm to permit movement of the first and second wipers between the first and second orientations.

11. The wiper apparatus of claim 10 further comprising a releasable lock for releasably locking the shaft to the arm to prevent rotation of the shaft.

12. The wiper apparatus of claim 11 wherein the releasable lock comprises a fastener coupled to the bearing and movable between a locked position in which the fastener locks the shaft to prevent the shaft from rotating and an unlocked position in which the fastener unlocks the shaft to permit rotation of the shaft to move the first and second wipers between the first and second orientations.

13. The wiper apparatus of claim 9 wherein the wiper support further includes first and second wiper holders, at least one of which is secured to the shaft, the first wiper holder secured to the first wiper and the second wiper holder secured to the second wiper.

14. The wiper apparatus of claim 8 wherein there are two arms, the arms being spaced apart from each other and disposed about the first and second wipers.

15. A wiper apparatus for wiping liquid coating material on a surface of a moving strip, the wiper apparatus comprising:

first and second wipers, each wiper for alternately wiping the liquid coating material on the surface of the moving strip;

a wiper support coupled to the first and second wipers for moving the first and second wipers between a first orientation wherein the first wiper is adjacent the surface of the moving strip for wiping the liquid coating material on the surface of the moving strip and the second wiper is spaced from the surface of the moving strip, and a second orientation wherein the second wiper is adjacent the surface of the moving strip for wiping the liquid coating material on the surface of the moving strip and the first wiper is spaced from the surface of the moving strip, the wiper support including at least one shaft coupled to at least one of the first and second wipers, the shaft rotatable to move the first and second wipers between the first and second orientations; and a lift assembly coupled to the shaft for moving the first and second wipers between an engaged position in which the first and second wipers are in one of the first and second orientations and a disengaged position in which both of the first and second wipers are spaced from the surface of the moving strip.

16. The wiper apparatus of claim 15 wherein the wiper support further includes first and second wiper holders, at least one of which is secured to the shaft, the first and second wiper holders defining a passageway receiving the shaft, the first wiper holder secured to the first wiper and the second wiper holder secured to the second wiper.

17. The wiper apparatus of claim 15 wherein the lift assembly includes at least one arm, the wiper support includes a bearing engaging the arm and the shaft to permit rotation of the shaft relative to the arm.

18. The wiper apparatus of claim 15 further comprising a releasable lock for releasably locking the shaft to the arm to prevent rotation of the shaft relative to the arm when the first and second wipers are in the engaged position.

19. The wiper apparatus of claim 15 wherein there are two arms, the arms being spaced apart from each other and disposed about the first and second wipers.

20. A wiper apparatus for wiping liquid coating material on a surface of a moving strip, the wiper apparatus comprising:

first and second wipers, each wiper for alternately wiping the liquid coating material on the surface of the moving strip;

a wiper support coupled to the first and second wipers for moving the first and second wipers between a first orientation wherein the first wiper is adjacent the surface of the moving strip for wiping the liquid coating material on the surface of the moving strip and the second wiper is spaced from the surface of the moving strip, and a second orientation wherein the second wiper is adjacent the surface of the moving strip for wiping the liquid coating material on the surface of the moving strip and the first wiper is spaced from the surface of the moving strip, the wiper support including first and second wiper holders defining a passageway and a pair of shafts received within the passageway, each shaft secured to at least one of the first wiper holder and the second wiper holder, the shafts rotatable to move the first and second wipers between the first and second orientations; and a lift assembly comprising a pair of arms coupled to the shafts for moving the first and second wipers between an engaged position in which the first and second wipers are in one of the first and second orientations and a disengaged position in which both of the first and second wipers are spaced from the surface of the moving strip.

* * * * *